US008624661B2

(12) United States Patent
Oberhuber et al.

(10) Patent No.: US 8,624,661 B2
(45) Date of Patent: Jan. 7, 2014

(54) METHOD AND CIRCUIT FOR CURVATURE CORRECTION IN BANDGAP REFERENCES WITH ASYMMETRIC CURVATURE

(75) Inventors: Ralph Oberhuber, Plano, TX (US); Keith Brouse, Murphy, TX (US)

(73) Assignee: Texas Instruments Incorporated, Dallas, TX (US)

( * ) Notice: Subject to any disclaimer, the term of this patent is extended or adjusted under 35 U.S.C. 154(b) by 1117 days.

(21) Appl. No.: 11/962,251

(22) Filed: Dec. 21, 2007

(65) Prior Publication Data

US 2008/0164938 A1 Jul. 10, 2008

Related U.S. Application Data

(60) Provisional application No. 60/871,699, filed on Dec. 22, 2006.

(51) Int. Cl.
*G06G 7/12* (2006.01)

(52) U.S. Cl.
USPC ..... 327/362

(58) Field of Classification Search
USPC ..... 327/362, 378, 512, 513, 538, 539, 541, 327/543; 323/313, 315
See application file for complete search history.

(56) References Cited

U.S. PATENT DOCUMENTS 5,231,360 A * 7/1993 Storey ..... 330/86
5,448,158 A 9/1995 Ryat
5,481,180 A 1/1996 Ryat
5,936,392 A 8/1999 Taylor
6,958,643 B2 * 10/2005 Rosenthal ..... 327/540
7,038,447 B2 * 5/2006 Motz ..... 324/249
7,199,646 B1 * 4/2007 Zupcau et al. ..... 327/539
7,331,708 B2 * 2/2008 Blom et al. ..... 374/171

FOREIGN PATENT DOCUMENTS

WO 2005033820 A1 4/2005

* cited by examiner

*Primary Examiner* — Lincoln Donovan
*Assistant Examiner* — Sibin Chen
(74) *Attorney, Agent, or Firm* — Alan A. R. Cooper; W. James Brady, III; Frederick J. Telecky, Jr.

(57) ABSTRACT

A non-linear correction current ICTAT2 (current complementary to the square of absolute temperature) is generated from a current IPTAT (current proportional to absolute temperature) and a current ICTAT (current complementary to absolute temperature), both modified in a circuit having a topology and components which capitalize on the logarithmic relationship between transistor collector current and base-emitter voltage. The resulting ICTAT2 current (current complementary to the square of absolute temperature) is injected into a node of a bandgap reference circuit to compensate for non-linear temperature effects on output voltage. A more general correction circuit generates both IPTAT2 and ICTAT2, and applies each to a respective multiplier which, in a preferred embodiment, is a current DAC configured as a multiplier. Control inputs CTL1 and CTL2 to respective multipliers set the amplitudes of the modified IPTAT2 and ICTAT2 output currents, which are then summed to generate the compensating current Icomp which is injected to the appropriate node in the bandgap reference circuit as described above. By adjusting the relative amplitudes of the IPTAT2 and ICTAT2 currents, a wide range of compensating current versus voltage curves is produced, allowing the optimization of a wide range of bandgap reference circuits. An optimal value for CTL1 is determined by holding CTL2 constant, then measuring curvature at a plurality of CTL1 values. That CTL1 value closest to the interpolated value at which curvature is minimized is then used.

13 Claims, 7 Drawing Sheets

METHOD AND CIRCUIT FOR CURVATURE CORRECTION IN BANDGAP REFERENCES WITH ASYMMETRIC CURVATURE

BACKGROUND OF THE INVENTION

1. Field of the Invention

This invention relates generally to temperature compensation of bandgap voltage references, and more specifically to correction of non-linear output voltage versus temperature errors by generating and applying a correction signal or a superposition of a plurality of correction signals having a second or higher order relationship to temperature, proportional to absolute temperature (PTAT) or complementary to absolute temperature (CTAT).

2. Description of the Related Art

Bandgap references such as that using a Brokaw architecture typically generate an output voltage which is the sum of 1) the voltage drop across a semiconductor junction, having a temperature coefficient complementary to absolute temperature (CTAT), and 2) a voltage having a temperature coefficient proportional to absolute temperature (PTAT); wherein the temperature coefficients of the CTAT and PTAT voltages have approximately the same magnitude but opposite sign. The resulting output voltage is thus relatively stable over a wide range of temperature, since the positive and negative temperature coefficients of the summed voltages cancel. There remains, however, a residual temperature effect on voltage which, in theory, introduces an increasingly negative error as temperature varies either above or below the nominal operating temperature (Tn). Theory predicts second and higher order effects, but terms higher than second order are quite small. The theoretical equation has a T*ln(T) term, and the second order correction compensates for the parabolic term of the Taylor expansion of this T*ln(T) dependency. The resulting voltage versus temperature curve appears to have primarily a parabolic curvature.

Correction circuits have been developed which typically generate a current proportional to the square of temperature, which, when injected at an appropriate node in the bandgap reference circuit, acts to decrease the output voltage error. The current typically generated is $PTAT^2$ (IPTAT2) which increases as the square of temperature. This current is injected into a node of the bandgap reference circuit, generating a correction voltage. When the resulting correction voltage is added to the parabolic uncompensated output voltage, the parabolic curve thus becomes more S-shaped, reducing the output voltage error over a given temperature span.

In some actual integrated bandgap reference circuits, however, the uncompensated voltage versus temperature relationship is not the parabolic curve predicted by theory. Differences in processes, structures, and other variables lead, in many cases, to a voltage having little error above a nominal temperature, but pronounced curvature (voltage error increasing as the square of change in temperature) as temperature decreases from nominal. Applying known compensation to such circuits has a smaller than desired effect on error below Tn, and may increase rather than reduce the error above Tn.

A circuit which will correct the output voltage of a bandgap reference circuit over a wide temperature range is therefore desirable, providing correction in the temperature region or regions needing such correction, in whichever direction is required, and without introducing additional error in a temperature region not needing correction.

SUMMARY OF THE INVENTION

The invention provides a method and apparatus for generating a correction current in a bandgap reference circuit, wherein the correction current is, in one embodiment, small at some nominal temperature Tn, increasing in a non-linear or 1/T manner as temperature decreases below Tn. This correction current is generated in a circuit having a known architecture which has as inputs both a PTAT current and a CTAT current. Whereas in the prior art such currents in this architecture result in a current $PTAT^2$ (which will also be referred to herein as IPTAT2), in the embodiment to be described, a CTAT correction current (ICTAT2) is generated by reversing the PTAT and CTAT inputs to the same circuit topology. The resulting correction current is injected to a node in the bandgap reference circuit which converts the current into a corresponding voltage correction. This correction current has little effect on output voltage above a nominal temperature, while providing increasing correction as temperature decreases from nominal.

Another embodiment generates both a IPTAT2 current, increasing as a square or higher order function of increasing temperature, and a ICTAT2 current, increasing as a square or higher order function of decreasing temperature. Control signals are applied to two multipliers, one having IPTAT2 as an input, the other having ICTAT2 as an input. The outputs of these multipliers are summed, and the resulting current is applied to an appropriate node in the bandgap reference circuit to effect the desired correction of output voltage. By modifying the control signal to each multiplier and thereby adjusting the gain of each multiplier, the relative amounts of ICTAT2 and IPTAT2 currents are adjusted to optimize correction.

As further described below, the disclosed embodiments provide a combination of desirable properties not available in the known art. Further benefits and advantages will become apparent to those skilled in the art to which the invention relates.

DESCRIPTION OF THE VIEWS OF THE DRAWINGS

Throughout the drawings, like elements are referred to by like numerals.

DETAILED DESCRIPTION

Figure 1:
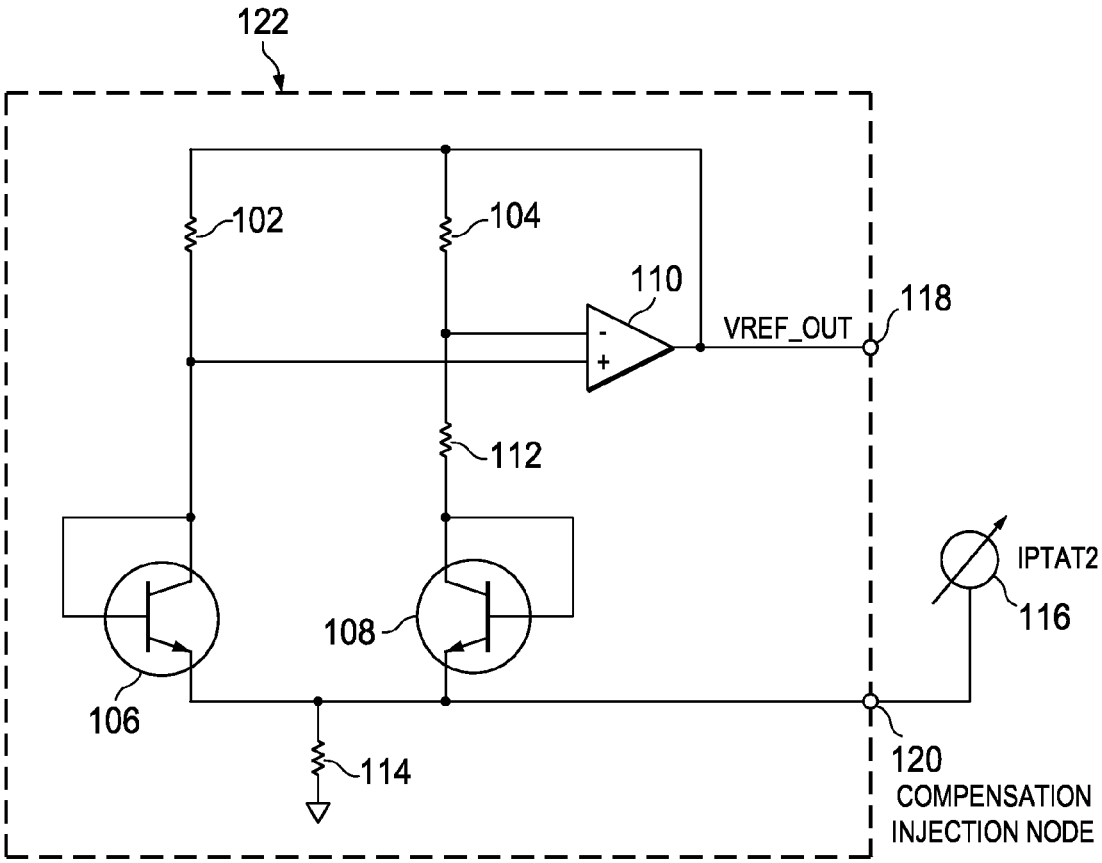
FIG. 1 (PRIOR ART)
FIG. 1 (prior art) is a block diagram of a typical Brokaw bandgap reference

In FIG. 1 (prior art), the output of amplifier 110 is coupled to a first terminal of resistors 102 and 104 and to output terminal 118. The second terminal of resistor 102 is coupled to the non-inverting input of amplifier 110 and to the collector and base of transistor 106. The second terminal of resistor 104 is coupled to the inverting input of amplifier 110 and to a first terminal of resistor 112. The second terminal of resistor 112 is coupled to the collector and base of transistor 108. The emitters of both transistor 106 and transistor 108 are coupled together, and are coupled to the first terminal of resistor 114, terminal 120, and current source 116. The second terminal of 114 is coupled to ground.

In operation, because resistor 102 and resistor 104 are substantially equal, when equal currents flow through both resistors the voltage drops across them are substantially equal. Since the currents flowing into the inputs of amplifier 110 are typically negligible, the current in transistor 106 is substantially equal to the current in transistor 108. The junction area of transistor 108 is larger than the junction area of transistor 106. Because of this difference in current density in these transistors, when substantially equal currents flow through them, the voltage drop across the base-emitter junction of the larger junction in transistor 108 is less than the voltage drop across the base-emitter junction of transistor 106. As described in the literature, the theoretical difference in voltage drop is deltaVbe=(kT/q)ln(J1/J2), where J1 and J2 are the current densities of transistor 106 and transistor 108 respectively. This deltaVbe is proportional to absolute temperature, commonly referred to as PTAT. With equal currents in both transistors and with the inputs to amplifier 110 substantially equal, the voltage deltaVbe, with PTAT characteristic, appears across resistor 112. The current flowing through resistor 112 thus also has a PTAT characteristic, but with a temperature coefficient significantly less than the negative temperature coefficient of the voltage drop across the base emitter junction of transistor 108. Since negligible current flows into the inputs of amplifier 110, the PTAT current through resistor 112 is substantially the same as the current through resistor 104. By selecting the value of resistor 104, the PTAT temperature coefficient of the voltage drop across the series combination of resistor 112 and resistor 104 is made substantially the same as the CTAT temperature coefficient of the base emitter junction of transistor 108. The output of amplifier 110 is thus a reference voltage of approximately 1.2 volts, which is substantially constant over a wide temperature range.

Figure 2:
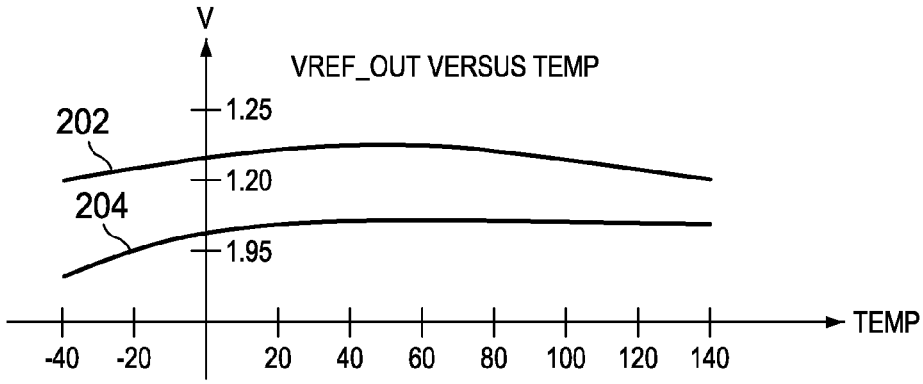
FIG. 2 (PRIOR ART)
FIG. 2 is a graph showing the theoretical and actual uncompensated output voltages of a bandgap reference circuit.

In FIG. 2, the predominant second order temperature versus voltage characteristic of a theoretical bandgap reference circuit of FIG. 1 is shown by curve 202 (higher order temperature effects on voltage are assumed small and therefore are ignored in this case). The temperature versus voltage characteristic of a representative actual bandgap reference circuit is shown by curve 204. Prior art compensation circuits typically generate a current IPTAT2, which increases with the square of temperature. While this IPTAT2 compensation is appropriate given a bandgap reference having the characteristic of curve 202, it is inappropriate for that bandgap reference circuit having the characteristic of curve 204. It is desirable to compensate the actual curve 204 with a voltage which increases in a non-linear manner as temperature decreases rather than increases.

Figure 3A:
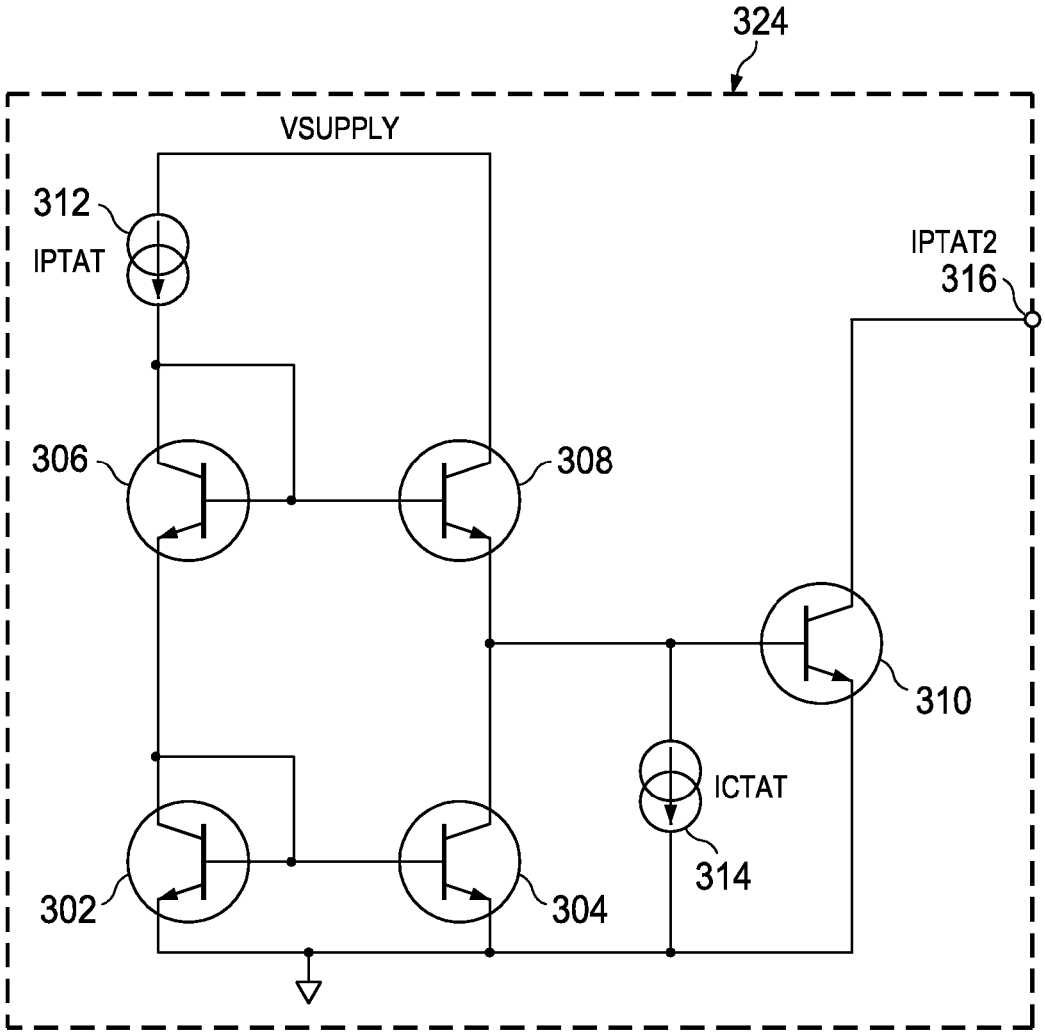
FIG. 3A (PRIOR ART)
FIG. 3 is a block diagram of a circuit which generates IPTAT2 and one which generates ICTAT2, and graphs of the respective voltage versus temperature compensation each provides.

In FIG. 3A, a known circuit for generating current IPTAT2 is shown. The topology described in FIG. 3 utilizes bipolar transistors having a control terminal which is a base, a first current terminal which is an emitter, and a second current terminal which is a collector. Transistor 302 has its emitter coupled to ground, its collector coupled to its base, to the base of transistor 304, and to the emitter of transistor 306. The base of transistor 306 is coupled to the collector of transistor 306, to the second terminal of current source 312 and to the base of transistor 308. The first terminal of current source 312 is coupled to the collector of transistor 308 and the supply voltage. The emitter of transistor 308 is coupled to the collector of transistor 304, the first terminal of current source 314, and the base of transistor 310. The second terminal of current source 314 is coupled to ground, as are the emitters of transistor 304 and transistor 310. The collector of transistor 310 is coupled to output terminal 316.

Figure 3B:
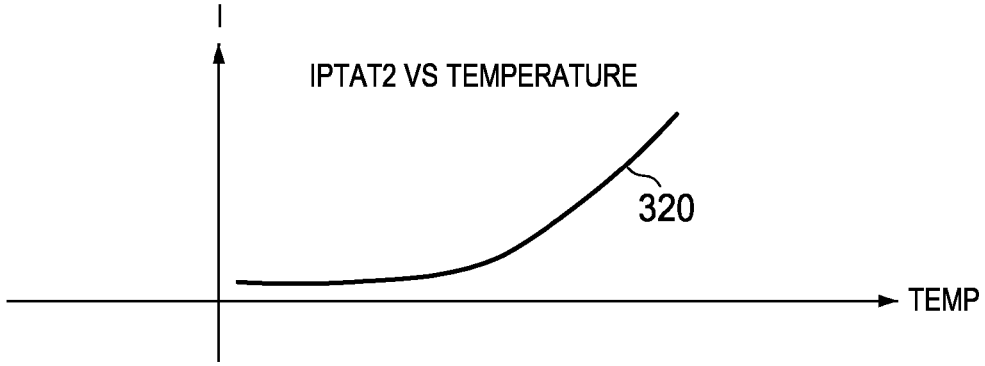
FIG. 3B (PRIOR ART)

In operation, the topology of the circuit of FIG. 3A, when current IPTAT and current ICTAT are coupled as shown, results in a current IPTAT2 at output terminal 316 which is proportional to the square of temperature and increases with increasing absolute temperature as shown in graph 320 of FIG. 3B. The operation of the circuit of FIG. 3A is known and described in the literature. In this circuit, a PTAT current and a first-order temperature-stable current is used in a base-emitter loop to produce the desired IPTAT2 current. Summing a CTAT and a PTAT current generates the temperature-independent current. The intrinsic voltage loop is composed of transistors 302, 306, 310, 308. The resulting output current is derived by summing the voltages in the loop (applying Kirchhoffs Voltage Law) as shown in the following equation:

$$V_{BE}(302)-V_{BE}(306)=V_{BE}(310)-V_{BE}(308).$$

In the following, the definitions $I_C(\mathbf{310})=I_{OUT}$ and $I_C(\mathbf{306})=I_C(\mathbf{302})=I_C(\mathbf{304})=I_{PTAT}$ as well as $I_C(\mathbf{308})=I_{PTAT}+I_{CTAT}$ will be used, and—to simplify calculations—it is assumed that transistors 302, 304, 306, 308 and 310 have the same emitter area A.

Then, substituting equation $$V_{BE} = V_T \ln\left(\frac{I_C}{I_S \cdot A}\right)$$

for each base-emitter voltage, where $V_T$, A, and $I_S$ are constants, yields $$\ln\left[\frac{I_{out} \cdot (IPTAT + ICTAT)}{IPTAT + IPTAT}\right] = 0$$

or $$I_{OUT} = \frac{IPTAT^2}{(IPTAT + ICTAT)} \approx \frac{IPTAT^2}{K} \equiv IPTAT2$$

where K is substantially constant. Another embodiment of the prior art circuit uses MOSFET transistors for transistors 306 and 308. The MOS devices, however, must operate in the subthreshold (weak inversion) region. This requirement arises because the drain current is exponentially dependent on the gate-source voltage only in subthreshold, which is the characteristic exploited by the circuit topology. In this case, $$V_{GS} = V_T \ln\left(\frac{I_{DS}}{c \cdot W/L}\right)$$

holds—where $V_T$ and c are constant and W/L is the aspect ration of the MOS device—and the calculation can be carried out in a similar manner as shown above.

Figure 3C:
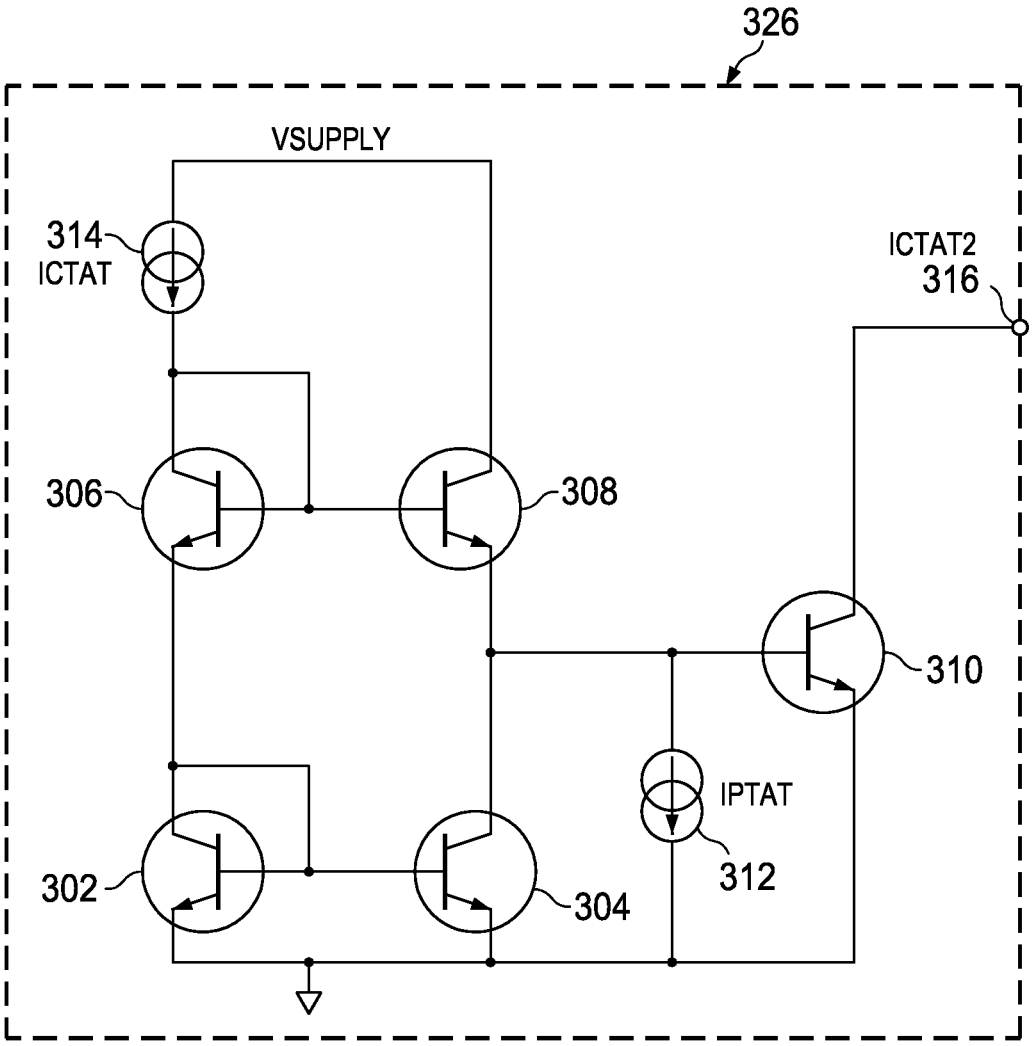

In FIG. 3C, the circuit of FIG. 3A is shown, however the ICTAT and IPTAT generators are interchanged. Therefore, in the topology of FIG. 3C, the first terminal of current source 314 is coupled to the supply voltage, while the second terminal of current source 314 is coupled to the node comprising the base and collector of transistor 306, and the base of transistor 308. The first terminal of current source 312 is coupled to the node comprising the emitter of transistor 308, the collector of transistor 304, and the base of transistor 310. The second terminal of current source 312 is coupled to ground.

Figure 3D:
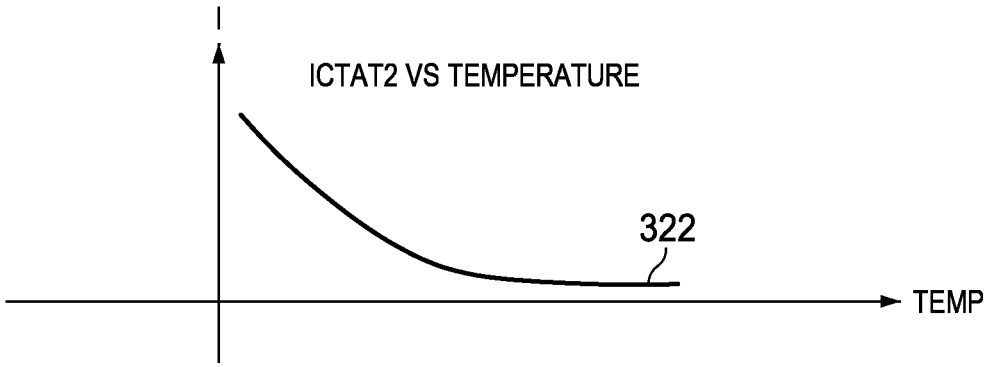

In operation, the interchange of IPTAT current source 312 and ICTAT current source 314 causes the creation of a current ICTAT2 which is complementary to the square of temperature, thereby increasing with decreasing absolute temperature as shown in graph 322 of FIG. 3D. This current ICTAT2 is coupled to output terminal 316. In this circuit, a PTAT current and a first-order temperature-stable current is used in a base-emitter loop to produce the desired ICTAT2 current. Summing a CTAT and a PTAT current generates the temperature-independent current. The intrinsic voltage loop is composed of transistors 302, 306, 310, 308. The resulting output current is derived by summing the voltages in the loop (applying Kirchhoffs Voltage Law) as shown in the following equation:

$$V_{BE}(302)-V_{BE}(306)=V_{BE}(310)-V_{BE}(308).$$

In the following, the definitions $I_C(\mathbf{310})=I_{OUT}$ and $I_C(\mathbf{306})=I_C(\mathbf{302})=I_C(\mathbf{304})=I_{CTAT}$ as well as $I_C(\mathbf{308})=I_{PTAT}+I_{CTAT}$ will be used, and—to simplify calculations—it is assumed that transistors 302, 304, 306, 308 and 310 have the same emitter area A.

Then, substituting equation $$V_{BE} = V_T \ln\left(\frac{I_C}{I_S \cdot A}\right)$$

for each base-emitter voltage, where $V_T$, A, and $I_S$ are constants, yields $$\ln\left[\frac{I_{out} \cdot (ICTAT + IPTAT)}{ICTAT \cdot ICTAT}\right] = 0$$

or $$I_{OUT} = \frac{ICTAT^2}{(ICTAT + IPTAT)} \approx \frac{ICTAT^2}{K} \equiv ICTAT2$$

where K is substantially constant. Another embodiment of the invention uses MOSFET transistors for transistors 306 and 308. The MOS devices, however, must operate in the subthreshold (weak inversion) region. This requirement arises because the drain current is exponentially dependent on the gate-source voltage only in subthreshold, which is the characteristic exploited by the circuit topology. In this case, $$V_{GS} = V_T \ln\left(\frac{I_{DS}}{c \cdot W/L}\right)$$

holds—where $V_T$ and c are constant and W/L is the aspect ration of the MOS device—and the calculation can be carried out in a similar manner as shown above.

Figure 4:
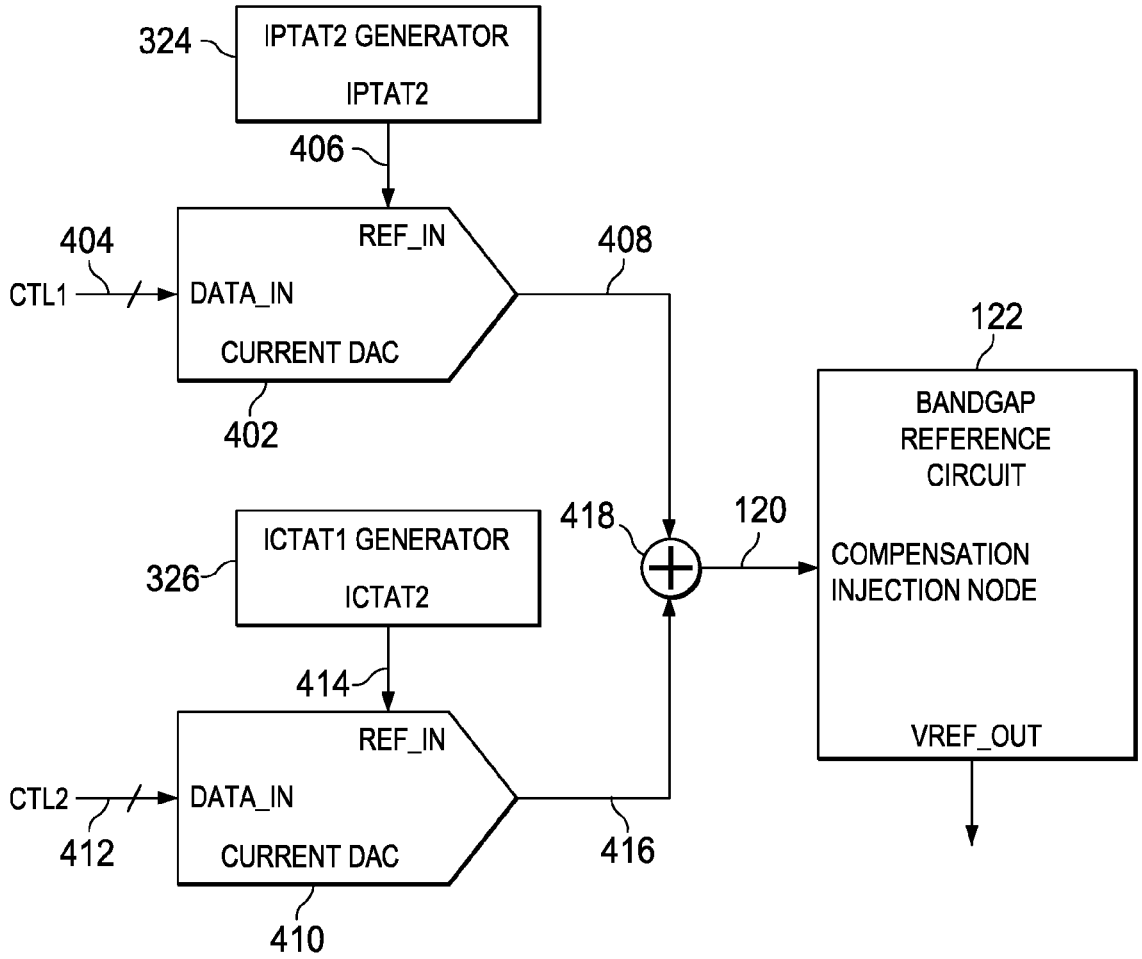
FIG. 4 is a block diagram of a correction circuit generating both IPTAT2 and ICTAT2 currents, controlling the relative amplitudes of each, and summing the resulting currents, so as to provide an adjustable, generalized correction.

In FIG. 4, another embodiment of the invention generates a plurality of currents having differing temperature coefficients, the amplitude each of which is controlled, which are then added together. A current generator IPTAT2 324 has its output coupled to reference input REF_IN 406 of a first current digital to analog converter (DAC) 402. A digital control signal CTL1 404 is coupled to the data input DATA_IN of said first current DAC 402. Because the output of a typical current DAC is the reference current multiplied by the digital input, the current DAC in this embodiment acts as a multiplier of the analog IPTAT2 input current and the CTL1 digital control signal to generate a modified current IPTAT2M. A current generator ICTAT2 326 has its output coupled to reference input REF_IN 414 of a next current DAC 410. A digital control signal CTL2 412 is coupled to the data input DATA_IN of said next current DAC 410. The said next current DAC acts as a multiplier of the analog ICTAT2 input current and the CTL2 digital control signal to generate a modified current ICTAT2M. Output 408 of current DAC 402 and output 416 of current DAC 410 are coupled to first and next inputs of summing node 418. The output of summing node 418 is coupled to compensation injection node 120 of bandgap reference circuit 122.

In operation, a digital signal proportional to the desired positive or negative modified amplitude of IPTAT2 is input to the control input CTL1 of first current DAC 402, while the unmodified signal IPTAT2 is input to the reference input of current DAC 402. The resulting current IPTAT2M output from current DAC 402 is thus the reference current IPTAT2 multiplied by the CTL1 value.

In a similar fashion, a digital signal proportional to the desired positive or negative modified amplitude of ICTAT2 is input to the control input CTL2 of next current DAC 410, while the unmodified signal ICTAT2 is input to the reference input of current DAC 410. The resulting current ICTAT2M output from current DAC 410 is thus the reference current ICTAT2 multiplied by the CTL2 value. The outputs of current DAC 402 and current DAC 410 are then summed in summing node 418, which output is thus the superposition of the plurality of currents generated as described above. By adjusting the control inputs, the superposition of currents from the plurality of current DACs thus can generate a plurality of compensating current versus temperature curves. Those skilled in the art will recognize that other embodiments might use differing circuits to multiply the current by a control signal, with substantially equivalent results.

Determination of optimal values for CTL1 and CTL2 may be done, manually or in an automated manner, using a novel method described below. As described in the detail of operation for the circuits of FIG. 3, the IPTAT2 compensation current is proportional to the square of increasing temperature, and as such its compensating influence is primarily in the region above a nominal temperature. The ICTAT2 compensation current, on the other hand, is proportional to the square of decreasing temperature, and as such its compensating influence is primarily in the region below a nominal temperature. While there is some interdependence of effect of IPTAT2 and ICTAT2 in the temperature region around nominal temperature, this interdependence shrinks at temperatures well above or well below nominal. It is therefore possible to vary CTL1 (affecting IPTAT2) while measuring its effect on curvature in a region above nominal temperature, and determine what value of CTL1 minimizes curvature in that region. Likewise, CTL2 may be varied and its effect in curvature in a temperature region below nominal may be measured, to determine an optimal value for CTL2 which minimizes curvature in this second region. Additional iterations of this process may be done to further minimize any effects of interdependence between IPTAT2 and ICTAT2 compensation.

Figure 5:
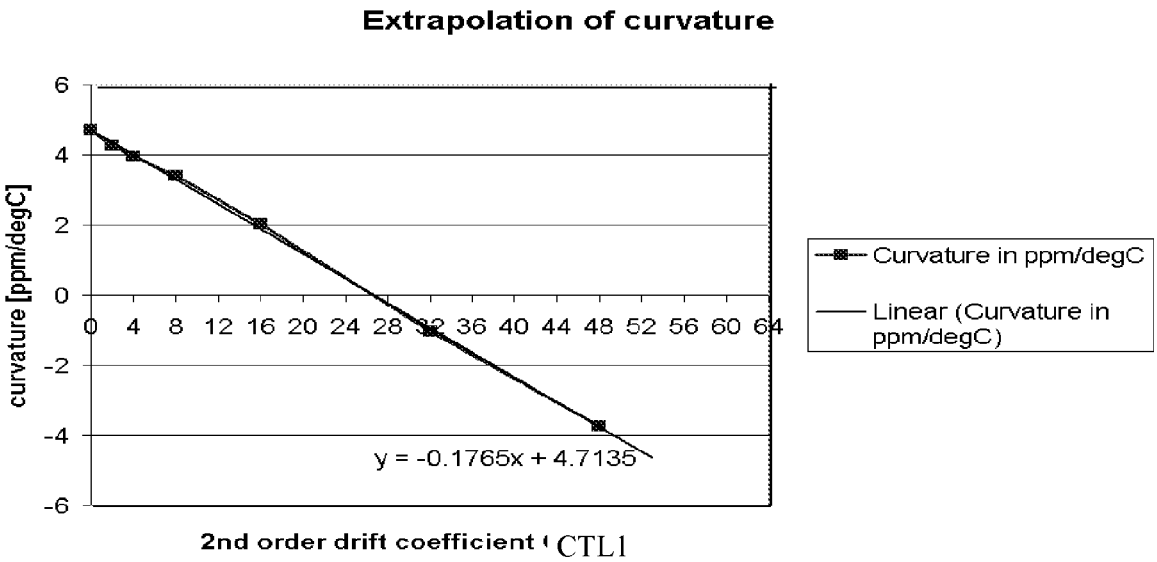
FIG. 5 is a graph of the curvature (output voltage change over temperature) for a plurality of values of CTL1 of the circuit described in FIG. 4, showing an optimal value of CTL1 which minimizes curvature.

As shown in FIG. 5, the curvature of output voltage versus temperature at a plurality of CTL1 values may be measured and plotted, to determine that optimal value of CTL1 where the curvature is zero. In FIG. 5, curvature, expressed in ppm/degree C. change in the compensated output voltage versus temperature, is plotted against decimal values for CTL1 of (for example) 0, 1, 2, 4, 8, 16, 32, and 48. By interpolating the resulting set of data points of curvature versus CTL1, the decimal value for CTL1 at curvature nearest zero may be determined. The optimal binary value of CTL1 is then that binary value closest to the interpolated decimal value.

It will be apparent to those skilled in the art that, for some circuits, a suitably accurate optimal CTL1 may be computed from a small subset of data points, in some cases as few as two. For example, with CTL1 equal to 16 and 48 in the example of FIG. 5, a linear interpolation between these two data points crosses the zero curvature axis at approximately CTL1=27. In other applications, other values for CTL1, represented by one or more bits, may be effectively utilized in determining the nearest CTL1 value for zero curvature.

Figure 6:
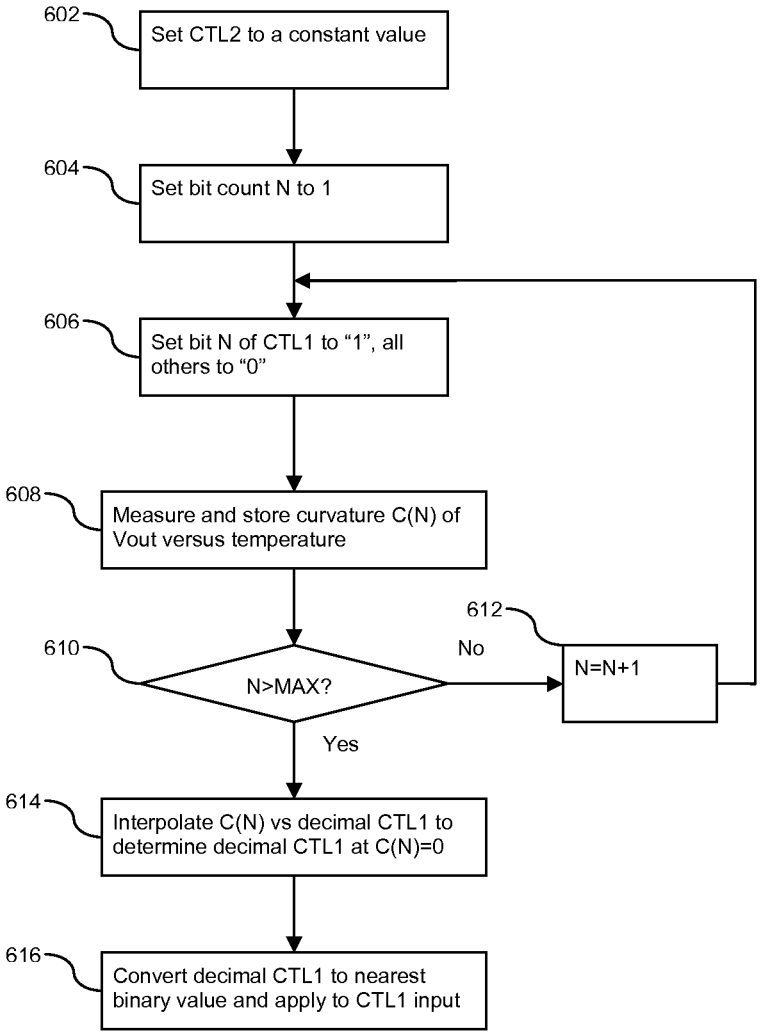
FIG. 6 is a flow chart describing a method for determining that optimal value of CTL1 in the circuit of FIG. 4.

FIG. 6 shows a flow chart for creating a set of curvature C versus CTL1 values when CTL1 is a binary number. At step 602, CTL2 is set to a value, for example zero, which will remain constant for the rest of the process. At step 604, a counter value N, representing the bit number of binary number CTL1, is set to a starting value of 1. This bit 1 represents the least significant bit (LSB) of CTL1. At step 606, bit N is set to "1". In the first iteration of the process, N=1 so bit 1 is the LSB. At step 608, the output voltage V(N,T) of the compensated circuit, with CTL1 compensation having bit N at "1", is measured at a plurality of temperatures, and the curvature C(N) of the V versus T function for a CTL1 value having bit N at "1" is computed and stored. At step 610, N is compared with a value MAX to determine if all bits of the binary value CTL1 have been set to "1", indicating no further iteration is needed. The number MAX is the number of bits in CTL1. If N is not greater than MAX, at step 612 N is incremented by 1, then the process reverts to step 606. If N is greater than MAX, indicating all bits of CTL1 have been set to "1" in sequence, the process continues with step 614, where, by interpolation, the decimal value for CTL1 nearest that value at which C(N) is zero is determined. This decimal value of CTL1 is therefore that optimal value for CTL1 to minimize curvature C. At step 616, this decimal value for the optimal CTL1 is converted to binary and applied to the control inputs CTL1.

Those skilled in the art will recognize the efficiency of the process described above, in that the number of iterations used to generate the optimal CTL1 value is only the number of bits MAX. It will also be recognized that once an optimal CTL1 value is determined, a substantially identical process may be used to determine the optimal CTL2 value, by holding CTL1 constant while varying the value of CTL2 bit by bit as described above. Those skilled in the art will also recognize that the value at which CTL2 is held while CTL1 is varied does not need to be zero, but may rather be some other value, for example a value determined by statistical measurement of a plurality of circuits to be an average optimal value for the plurality of circuits. It is also clear that not every bit of CTL1 or CTL2 must be exercised (set to "1"), as long as those values chosen for CTL1 or CTL2 generate data points both above and below the zero curvature axis. Also, it is apparent that two or more temperatures may be used in determining C(N), and that computations may be carried out by special purpose or general purpose computers.

It will also be understood that there may be some interaction between CTL1 and CTL2; that is, the optimal value for CTL1 with CTL2=0 may not be the same optimal value of CTL1 with CTL2 at a non-zero value, such as its value after optimization. In this case, a next iteration of CTL1 may be desirable while holding CTL2 at its optimal value, followed if desired by a next iteration of CTL2 with the value of CTL1 resulting from its next iteration. In some cases it may be found that an average value of CTL2 is acceptable, and that only CTL1 need be optimized using the process described (or vice-versa).

Figure 7:
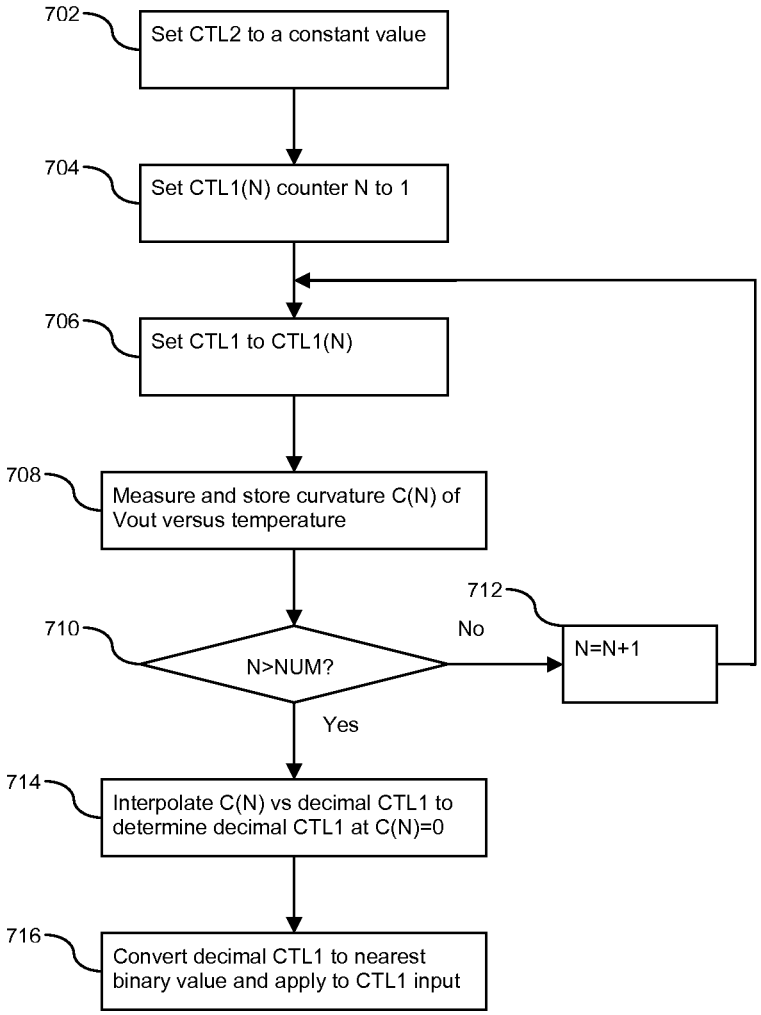
FIG. 7 is a flow chart describing another method for determining that optimal value of CTL1 in the circuit of FIG. 4.

In FIG. 7, curvature values C(N) are computed and stored for a set of multi-bit values of CTL1. At step 702, CTL2 is set to a value, for example zero, which will remain constant for the rest of the process. At step 704, a counter value N, representing the Nth value of a plurality of binary values for CTL1, is set to a starting value of 1. At step 706, CTL1 is set to the first stored value CTL1(N). At step 708, the output voltage V(N,T) of the compensated circuit, with CTL1 compensation having a value CTL1(N), is measured at a plurality of temperatures, and the curvature of the V versus T function at the CTL1(N) value is computed and stored. At step 710, N is compared with a value NUM to determine if all of the plurality of N stored binary values for CTL1 have been used, indicating no further iteration is needed. The number NUM is the number of stored binary values for CTL1. If N is less than or equal to NUM, another iteration is called for, and N is incremented by 1 at step 712, then the process reverts to step 706. If N is greater than NUM, indicating all stored values for CTL1 have been used, the process continues with step 714, where, by interpolation, the decimal value for CTL1 nearest that value at which C(N) is zero is determined. This decimal value of CTL1 is therefore that optimal value for CTL1 to minimize curvature C. At step 716, this decimal value for the optimal CTL1 is converted to binary and applied to the control inputs CTL1.

Those skilled in the art to which the invention relates will appreciate that, while the above methods describe optimizing the CTL1 value, an optimal value for CTL2 may be similarly determined by interchanging CTL1 and CTL2 in the methods described above. It is also obvious that in some cases there will be interaction between the CTL1 and CTL2 values, and therefore additional iterations may be desirable to optimize the combination of CTL1 and CTL2 for some circuits.

It should be understood that the use of Vdd, Vref, ground, etc., are illustrative only, and that implementations using single or dual power supplies and the like are equally possible. Moreover, reference voltages developed either internal to the circuit or external to the circuit will suffice. While field-effect and bipolar transistors have been shown in these embodiments, alternative topologies using field effect and bipolar transistors in differing topologies will provide substantially equivalent operation.

Those skilled in the art to which the invention relates will also appreciate that yet other substitutions and modifications can be made to the described embodiments, without departing from the spirit and scope of the invention as described by the claims below. Many alternatives to the circuits and sub circuits described are possible while retaining the scope and spirit of the invention.

What is claimed is:

1. An apparatus for generating an electrical current having a non-linear relationship to temperature, the apparatus comprising:

a first current generator having a first current which is directly proportional to the quadratic of absolute temperature;

a first multiplier that is coupled to the first current generator so as to receive the first current and that receives a first control signal, wherein the amplitude of the first current is modified by the first control signal so as to generate a first modified current;

a second current generator having a second current which is complementary to the quadratic of absolute temperature;

a second multiplier that is coupled to the second current generator so as to receive the second current and that receives a second control signal, wherein the amplitude of the second current is modified by the second control signal so as to generate a second modified current; and a current summing node that is coupled to the first multiplier and the second multiplier, wherein the current summing node outputs the sum of the first and second modified currents.

2. The apparatus of claim 1, wherein the first multiplier further comprises a first current digital to analog converter (current DAC) having its reference input coupled to the first current generator and having its data input receive the first control signal, and wherein the second multiplier further comprises a second current DAC having its reference input coupled to the second current generator and having its data input receive the second control signal.

3. The apparatus of claim 1, wherein the apparatus further comprises a bandgap reference circuit having a compensation input, wherein the compensation input is coupled to the summing node so as to receive the sum of the first and second modified currents.

4. The apparatus of claim 1, wherein the second current generator further comprises:

a first voltage rail;

a second voltage rail;

an output terminal operable to carry the second current;

a first current source that is coupled to the first voltage rail, wherein the first current source provides a current that is generally complementary to absolute temperature;

a first current mirror that is coupled to the first current source and the first voltage rail;

a second current mirror that is coupled between the first current mirror and the second voltage rail;

a second current source that is coupled between the first current mirror and the second voltage rail, wherein the second current source provides a current that is generally proportional to absolute temperature; and an output transistor that is coupled to the second current source at its control electrode and that is coupled to the output terminal at one of its passive electrodes.

5. The apparatus of claim 4, wherein the first current mirror further comprises:

a first NPN transistor that is diode connected and that is coupled to the first current source at its collector; and a second NPN transistor that is coupled to the base of the first NPN transistor at its base, and that is coupled to the first voltage rail at its collector.

6. The apparatus of claim 5, wherein the second current mirror further comprises:

a third NPN transistor that is diode connected, that is coupled to the emitter of the first NPN transistor at its collector, and that is coupled to the second voltage rail at its emitter; and a fourth NPN transistor that is coupled to the base of the third NPN transistor at its base, that is coupled to the emitter of the second NPN transistor and the second current source at its collector, and that is coupled to the second voltage rail at its emitter.

7. The apparatus of claim 1, wherein the quadratic is a square.

8. A method comprising:

generating a first current which varies directly proportional to the quadratic of absolute temperature;

generating a second current which varies complementary to the quadratic of absolute temperature;

multiplying the first current by a first control signal to create a first modified current;

multiplying the second current by a second control signal to create a second modified current;

summing the first and second currents to create a compensation current; and applying the compensation current to a bandgap reference circuit.

9. The method of claim 8, wherein the method further comprises the steps of:

setting the second control signal to a constant value;

setting a bit count value to 1;

setting a value for the control signal by setting bit of the first control signal corresponding to bit count value to "1", and the remainder of the bits of first control signal to "0";

measuring and storing a curvature value of an output voltage versus temperature at the value of the first control signal;

if the bit count value is not greater than a predetermined value, incrementing the bit count value by 1;

if the bit count value is greater than the predetermined value, interpolating the curvature value versus the first control signal to determine the value of the first control signal which minimizes the curvature value; and applying the value of the first control signal which minimizes the curvature value control input of a multiplier.

10. The method of claim 8, wherein the method further comprises the steps of:

setting the second control signal to a constant value;

setting a counter value to 1;

setting the first control signal to its stored value corresponding to the counter value of the counter value;

measuring and storing a curvature value of an output voltage versus temperature at the value of the first control signal;

if the counter value is not greater than a predetermined value, incrementing the counter value by 1;

if the counter value is greater than the predetermined value, interpolating the curvature value versus the first control signal to determine the value of the first control signal which minimizes the curvature value; and applying the value of the first control signal which minimizes the curvature value.

11. The method of claim 9, wherein the first and second control signals are interchanged so as to determine an optimal value for the second control signal.

12. The method of claim 10, wherein the first and second control signals are interchanged so as to determine an optimal value for the second control signal.

13. The method of claim 8, wherein the quadratic is a square.

* * * * *